United States Patent [19]

Suverkrop

[11] 4,241,837

[45] Dec. 30, 1980

[54] CONVERTIBLE ARTICULATED CRANE

[76] Inventor: Don Suverkrop, 3513 Century Dr., Bakersfield, Calif. 93306

[21] Appl. No.: 27,793

[22] Filed: Apr. 6, 1979

[51] Int. Cl.[3] ..... B66C 23/00

[52] U.S. Cl. ..... 212/177; 212/231

[58] Field of Search ..... 212/55, 58 R, 59 R, 212/144

[56] References Cited

U.S. PATENT DOCUMENTS

| | | | |
|---|---|---|---|
| Re. 27,763 | 9/1973 | Fauchere | 212/55 |
| 3,572,517 | 3/1971 | Liebherr et al. | 212/59 R |

*Primary Examiner*—Andres Kashnikow

[57] ABSTRACT

An articulated boom crane, constructed to allow convenient conversion to straight boom crane operation, and having a secondary boom that has adjustably extensible members supporting a boom tip assembly and that can be selectively coupled to a main boom either in an articulated crane configuration or in a straight boom crane configuration. In the disclosed embodiments, this selective coupling is effected by means of sets of attachment plates fixed to the secondary boom which allow either end portion of the boom to be attached to a pair of side plates pivotally connected to the main boom. Centering posts on the secondary boom aid in aligning the side plates and attachment plates, and tapered pins are engaged through holes in the plates, to provide their secure coupling. When the crane is in the straight boom configuration, stop plates on the side plate prevent movement of the secondary boom with respect to the main boom as a result of load forces. In an alternative embodiment of the invention, conversion to straight boom operation is achieved by use of an extensible member that can be extended from either end of the secondary boom, and a boom tip assembly that can be selectively attached to the projecting end of the extensible member.

22 Claims, 4 Drawing Figures

CONVERTIBLE ARTICULATED CRANE

BACKGROUND OF THE INVENTION

This invention relates generally to cranes, and, more particularly, to an articulated boom crane with a main boom and an upper secondary boom with extensible members.

Presently available boom cranes are generally either of the straight boom type or the articulated boom type. A conventional straight boom crane includes a main boom with telescopically extensible members, and a boom tip assembly supported at the end of the farthest reaching extensible member. The boom tip assembly contains sheaves to support and guide a cable, which carries a load to be lifted by the crane. Typically, the extensible members are hydraulically controlled and may be retracted into the main boom, or projected therefrom as a longitudinal extension of the main boom.

A conventional articulated boom crane includes a main boom and a secondary boom, with the secondary boom being pivotally connected to the upper end of the main boom. The secondary boom often includes telescopically extensible members, which are hydraulically controlled and are retractable into the secondary boom and extensible therefrom as a longitudinal extension of the secondary boom. As in straight boom cranes, a boom tip assembly is supported at the end of the farthest reaching extensible member. Such articulated boom cranes are shown in my U.S. Pat. Nos. 3,754,666 and 3,884,359.

Articulated boom cranes are extremely versatile, and can handle loads in a number of positions in which lifting would be difficult, if not impossible, for a straight boom crane. However, there are certain situations in which, because of the clearance requirements for unfolding and operation of the main and secondary booms of an articulated crane, a straight boom crane is required. For example, a straight boom crane is needed to lift a load positioned close to the crane in a structure providing low overhead clearance, or when the crane must be positioned close to a structure and it is necessary to reach with a load up and between closely spaced trusses or pipes.

A disadvantage of articulated boom cranes of the prior art has been their inability to operate in such situations in the same manner as a straight boom crane, with the telescopically extensible members serving as longitudinally adjustable extensions of the crane's main boom. Thus, in many instances where the aforementioned situations are encountered on a job, the otherwise preferred articulated crane cannot be used, or both an articulated and a straight boom crane must be kept at the job site in anticipation of the need for a straight boom crane.

It will therefore be appreciated that there has long been a need for an articulated boom crane that can be conveniently converted for straight boom crane operation. The present invention fulfills this need.

SUMMARY OF THE INVENTION

The present invention resides in an articulated boom crane, constructed to allow convenient conversion to straight boom crane operation. The crane includes a secondary boom that can be selectively coupled to a main boom, either in an articulated boom crane configuration or in a straight boom crane configuration, the secondary boom having adjustably extensible members.

In the straight boom configuration, the extensible members serve to adjustably extend the load carrying reach of the main boom.

In both configurations, the secondary boom is coupled to the upper end portion of the main boom by means of a pair of side plates that are pivotally connected to the main boom. In one embodiment of the invention, the conversion is achieved by use of two sets of attachment plates on the secondary boom, to allow selective attachment of either end portion of the secondary boom to the side plates on the main boom. Centering posts on the secondary boom are used to align the side plates and the attachment plates, and said plates have corresponding holes through which tapered pins are engaged, to provide their secure coupling. When in the straight boom configuration, stop plates are provided on the side plates to prevent movement of the secondary boom with respect to the main boom as a result of load forces. A boom tip assembly is supported by the extensible members for carrying a load.

In another embodiment of the invention, the conversion is achieved by use of an extensible member that can be extended from either end of the secondary boom. For operation as a straight boom crane, the secondary boom is folded under the main boom, and the extensible member is extended from the end of the secondary boom adjacent to the upper end of the main boom.

Other features and advantages of the invention will become apparent from the following detailed description, taken in conjunction with the accompanying drawings.

DETAILED DESCRIPTION

Figures 1, 2, 3, 4:
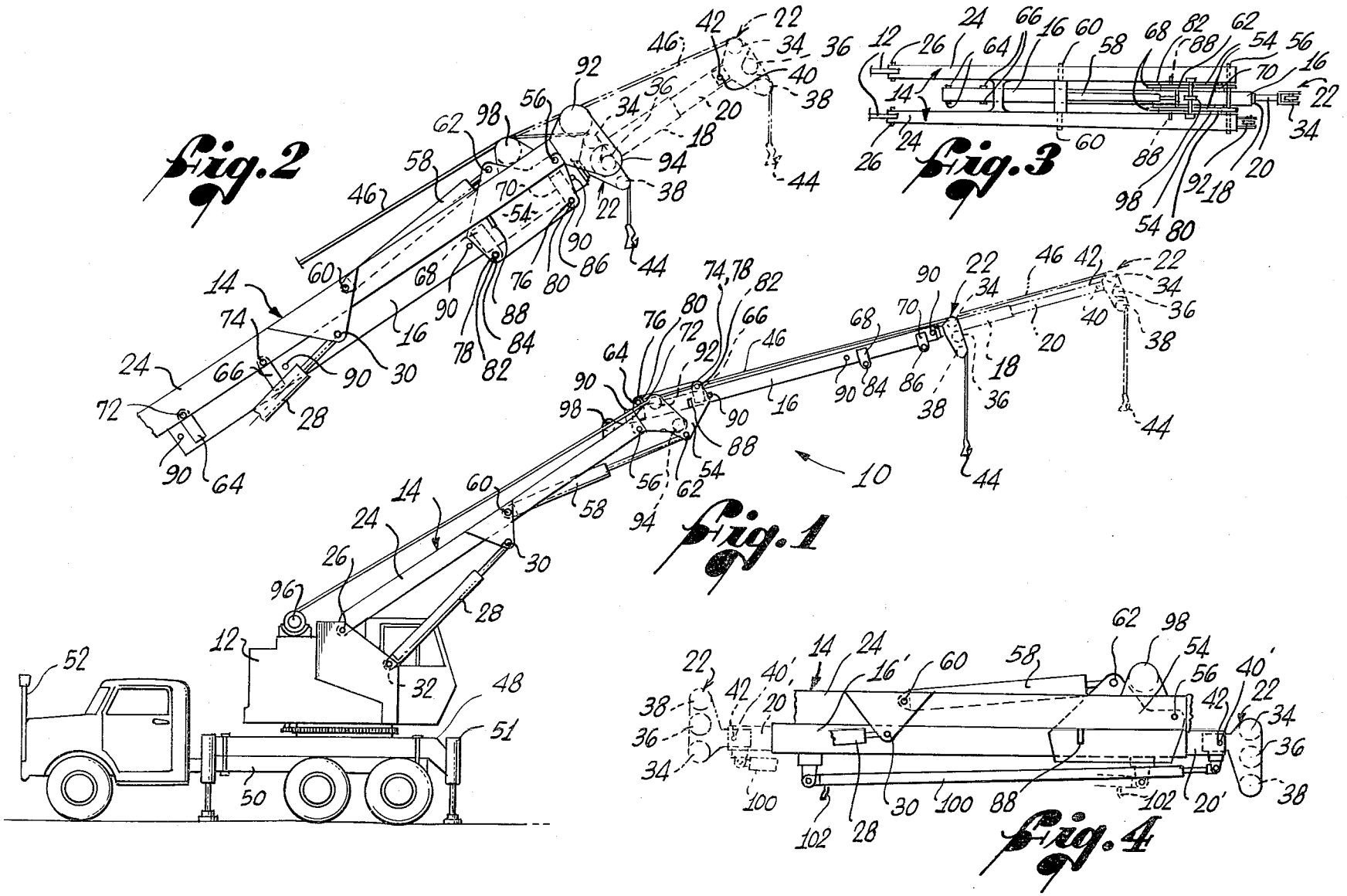
FIG. 1 is a side elevational view of a convertible articulated crane illustrating the principles of operation of the present invention, shown in operation, with the crane in the articulated boom configuration.
FIG. 2 is a fragmentary, enlarged scale, side elevational view of the crane shown in FIG. 1, with the crane converted for operation in the straight boom configuration.
FIG. 3 is a reduced scale, plan view of the main and secondary booms of the crane configuration shown in FIG. 2.
FIG. 4 is a fragmentary side elevational view of an alternative embodiment of the crane shown in FIG. 1, with an extensible member that can be extended from both ends of the secondary boom.

As shown in the drawings for purposes of illustration, the present invention is embodied in a convertible articulated boom crane, indicated generally by reference numeral 10. The crane 10 includes a base 12 for supporting a main boom 14 which, at its upper end, supports a secondary boom 16. The secondary boom has retractable extensible members 18 and 20 which support a boom tip assembly 22.

The main boom 14 comprises a pair of laterally spaced boom elements 24 pivotally connected at their lower end to the base 12 by means of pivot pins 26. A pair of hydraulic cylinder assemblies 28 are provided for raising and lowering the main boom in a vertical plane with respect to the base. Each hydraulic cylinder assembly 28 is pivotally attached at one end to a mid-portion of one laterally spaced boom element 24 of the main boom 14, at a pivot point 30. Each cylinder assembly 28 extends downward from the main boom, and is pivotally attached at its other end to the base 12, at a pivot point 32, located below the pivot pins 26. The hydraulic cylinder assemblies 28 move in unison to raise or lower the main boom 14 by pivoting it about the pivot pins 26.

Enclosed within the secondary boom 16 are extensible members 18 and 20, which are retractable into the secondary boom and adjustably extensible therefrom. The extensible members serve as a longitudinal extension of the secondary boom and thereby increase the load carrying reach of the boom. Member 20 is telescopically mounted within the coaxial member 18. A hydraulic cylinder assembly (not shown) is provided to adjustably extend member 20 with respect to member 18, and another hydraulic cylinder assembly (not shown) is provided to adjustably extend member 18 with respect to the secondary boom 16. The extensible members in partially extended position are indicated by the phantom lines in FIGS. 1 and 2.

A boom tip assembly 22, containing three sheaves 34, 36 and 38, is supported at the end of the farthest reaching extensible member 20. The member 20 and the assembly 22 both have corresponding holes 40 sized to receive a pin 42 for secure attachment of the assembly to the member. A weighted hook 44, for engagement with the load to be carried, is suspended from a cable 46, which passes over sheaves 34 and 38, and is guided by sheave 36.

The crane base 12 is mounted on a sub-base 48, which is secured to a conventional wheel-supported truck frame 50. The crane base 12 can be rotated about a vertical axis, by conventional means. Hydraulically operated outriggers 51 are mounted on the sub-base 48, for stabilization and support when the crane 10 is operating. A stationary support 52 is mounted to the truck frame to support the weight of the main boom 14 and secondary boom 16 when in a folded position for travel or storage. Although the crane is shown mounted on a truck frame for purposes of illustration, the present invention is, of course, also applicable to stationary platform cranes.

In accordance with the invention, the articulated boom crane 10, including the main boom 14, secondary boom 16, extensible members 18 and 20, and boom tip assembly 22, are so constructed and arranged that the crane can be conveniently converted to straight boom crane operation, with the extensible members 18 and 20 serving to adjustably extend the load carrying reach of the main boom.

More specifically, the secondary boom 16 is selectively coupled to a pair of spaced, parallel side plates 54, which are pivotally connected to the upper end portion of the main boom 14 by means of a pivot pin 56, to provide for independent movement of the secondary boom in substantially the same vertical plane as the main boom. The secondary boom 16 is positioned between the pair of side plates, which, in turn, are positioned between the spaced boom elements 24 of the main boom. A hydraulic cylinder assembly 58 is provided for pivoting the side plates 54 about the pivot pin 56. The assembly 58 is positioned between the spaced boom elements 24 of the main boom 14, and is pivotally attached at one end to the mid portion of the boom elements of the main boom, at a pivot point 60. The other end of the other end of the hydraulic cylinder assembly 58 is positioned between the pair of side plates 54, and is pivotally attached to the side plates, at a pivot point 62.

In the embodiment shown in FIGS. 1, 2 and 3, the secondary boom 16 is coupled to the side plates 54 by means of two of four pairs of attachment plates 64, 66, 68 and 70 on the secondary boom. Each pair of attachment plates comprises two substantially parallel, flat plates, with one plate rigidly attached to each side of the secondary boom and projecting beyond and substantially perpendicular to the longitudinal axis of the boom. For operation in the articulated boom crane configuration, the secondary boom utilizes the two pairs of attachment plates indicated by reference numerals 64 and 66 and located along the end portion of the secondary boom opposite the end from which the extensible members 18 and 20 project. Attachment plates 64 are located adjacent to the end of the secondary boom, and attachment plates 66 are longitudinally spaced therefrom, with respect to the boom. When the secondary boom is in the articulated boom operating position, as illustrated in FIG. 1, the attachment plates 64 and 66 protrude above the upper side of the secondary boom.

The attachment plates 64 and 66 have holes 72 and 74 that correspond to holes 76 and 78 in the side plates 54. Holes 72, 74, 76 and 78 are sized to receive cooperating pins 80 and 82 which hold the secondary boom 16 securely to the side plates.

For operation in the straight boom crane configuration, as shown in FIGS. 2 and 3, the side plates 54 are rotated and positioned with holes 76 and 78 below and substantially equally distant from the main boom 14. To couple the secondary boom 16 to the side plates in this configuration, the two pairs of attachment plates indicated by reference numerals 68 and 70 are utilized. These are located along the end portion of the secondary boom from which the extensible members 18 and 20 project. Attachment plates 70 are located adjacent to the end of the secondary boom, and attachment plates 68 are longitudinally spaced therefrom, with respect to the boom, by the same distance as plates 66 are spaced from plates 64. When the secondary boom 16 is in the operating position for the straight boom configuration, attachment plates 68 and 70 protrude below the lower side of the secondary boom. As with the attachment plates 64 and 66, plates 68 and 70 have holes 84 and 86 corresponding with the holes 78 and 76, respectively, in the side plates 54, and sized to receive pins 80 and 82 for secure attachment of the secondary boom to the side plates.

When the secondary boom 16 is converted for straight boom crane operation, with attachment plates 68 and 70 in use, the end of the secondary boom from which the extensible members 18 and 20 project is adjacent to the upper end portion of the main boom 14. In this configuration, the extensible members serve to adjustably extend the load carrying reach of the main boom, as shown in phantom in FIG. 2. If the secondary boom 16 is positioned substantially parallel to the main boom 14, the extensible members 18 and 20 provide a longitudinal extension of the main boom similar to that achieved by a conventional straight boom crane.

The side plates 54 have attached stop plates 88 that extend outward and perpendicular to the side plates and abut against the lower side of the main boom 14 to prevent rotation of the secondary boom 16 into the space between the laterally spaced boom elements 24 of the main boom. The stop plates 88 aid in the proper positioning of the side plates for coupling of the secondary boom in the straight boom configuration and in the folding of the secondary boom parallel to the main boom for storage or travel in the articulated boom configuration. The stop plates also relieve the hydraulic cylinder 58 of the tension that would otherwise occur as a result of load forces on the boom tip assembly 22 when the crane 10 is operated in the straight boom configuration.

Centering posts 90 are attached to and project perpendicularly from the sides of the secondary boom, and are located to the outside of each pair of attachment plates 64 and 66, and 68 and 70. The centering posts 90 contact the edges of the side plates 54 to guide the side plates when they are being positioned for connection to the secondary boom 16. The centering posts minimize misalignment of the holes 72, 74, 84 and 86 of the attachment plates with the holes 76 and 78 of the side plates, when the secondary boom is being attached to the side plates. The cooperating pins 80 and 82 are tapered to reduce the effect of any misalignment that might occur.

Two sheaves 92 and 94 are mounted on the upper end of one of the laterally spaced boom elements 24 of the main boom 14, with sheave 92 being mounted above sheave 94. The cable 46 passes over sheave 92 when the crane 10 is operated in the articulated configuration, and also over sheave 94 when the secondary boom 16, while still in the articulated configuration, is folded under the main boom 14 for travel or storage (not shown).

The cable 46 is wound on a power-operated drum 96 mounted on the base 12. If a second power-operated drum (not shown) is desired to operate an auxiliary cable (not shown), another set of sheaves corresponding to sheaves 92 and 94 can be mounted on the end of the second boom element 24 of the main boom 14.

For operation in the straight boom configuration a sheave 98 is mounted on the main boom 14 to carry the cable 46, instead of sheave 92. Sheave 98 is positioned above and between the spaced boom elements 24 of the main boom, thereby reducing the large horizontal deflection of the cable 46 from the optimum straight line path between power drum 96 and sheave 34 of the boom tip assembly 22 that would occur if sheave 92 were to be used with the extensible members 18 and 20 only partially extended. Sheave 98 is positioned down from the upper end of the main boom 14 to avoid interference with the rotation of the secondary boom 16 when the crane 10 is operated in the articulated configuration and sheave 98 is not used.

To convert the crane 10 from the articulated boom configuration to the straight boom configuration, the secondary boom 16 is folded under the main boom 14 and rested on free standing supports (not shown), such as work horses, that carry the weight of the secondary boom. The cable 46 is removed from the boom tip assembly 22 and any hydraulic lines (not shown) for the hydraulic cylinder assemblies (not shown) controlling the extensible members 18 and 20 are disconnected. Pins 80 and 82 are removed from holes 72 and 74 in attachment plates 64 and 66 and from holes 76 and 78 in the side plates 54, thereby disconnecting the attachment plates 64 and 66 from the side plates 54, and the main boom 14 is raised free of the secondary boom 16. The secondary boom must then be reversed end for end, and turned 180 degrees about its longitudinal axis so that the secondary boom is in a position to be re-attached to the side plates 54 using attachment plates 68 and 70. The reversal and rotation of the secondary boom 16 can be accomplished with the aid of a second crane (not shown), or the cable 46 can be temporarily strung over sheaves 92 and 94, and the lifting capability of the main boom 14 can be utilized.

With the side plates 54 rotated so that holes 78 and 76 in the side plates are below and substantially equally distant from the main boom 14, the main boom of the crane 10 is positioned essentially in a closely spaced parallel relationship with the secondary boom 16, with the side plates aligned with the attachment plates 68 and 70. The main boom 14 is then lowered, guided by the centering posts 90 contacting the edges of the side plates 54, until holes 78 and 76 in the side plates are in alignment with holes 84 and 86 in attachment plates 68 and 70. Pins 80 and 82 are then reinserted, all hydraulic lines are re-connected and the cable 46 is restrung over sheave 98 and sheaves 34, 36 and 38 of the boom tip assembly 22.

Another embodiment of the invention is illustrated in FIG. 4, and comprises a secondary boom 16' with an adjustably extensible member 20' that can be extended from either end of the secondary boom. Member 20' has holes 40', sized to receive pin 42, at each of its end portions for selective attachment of the boom tip assembly 22 to either end of the member.

In this latter embodiment, a hydraulic cylinder assembly 100 is mounted external to the extensible member 20' and the secondary boom 16', and is provided to adjustably extend the member with respect to the secondary boom. The hydraulic cylinder assembly 100 is connected to a hydraulic fluid line 102. In the articulated crane configuration, as shown by the phantom lines in FIG. 4, the hydraulic cylinder assembly 100 is detachably coupled at one end to the projecting end portion of extensible member 20' adjacent to the boom tip assembly 22. The other end of the assembly is detachably coupled to the end portion of the secondary boom 16' adjacent to the upper end of the main boom 14.

To convert the crane of FIG. 4 for operation in the straight boom configuration, the secondary boom 16' is folded under the main boom 14, and maintained substantially parallel thereto. The boom tip assembly 22, shown in phantom in FIG. 4 attached to extensible member 20', is removed. The hydraulic line 102 is disconnected and hydraulic cylinder assembly 100 is detached from the extensible member and the secondary boom, and the extensible member is manually extended from the end of the secondary boom adjacent to the upper end of the main boom. The hydraulic cylinder assembly 100 is then reversed end for end and detachably coupled at one end to the projecting portion of the extensible member 20' and at the other end to the end portion of the secondary boom 16' remote from the projecting portion of member 20'. The hydraulic line 102 is then re-connected and the boom tip assembly 22 is re-attached to member 20' at its projecting end.

It will be appreciated from the foregoing description that the present invention represents a significant advance in the field of articulated boom cranes. In particular, it provides a single crane that can be operated as an articulated crane, and when a situation requires, can be conveniently converted for operation as a straight boom crane. It will also be appreciated that, although specific embodiments of the invention have been described herein for purposes of illustration, various modifications may be made without departing from the spirit and scope of the invention. Accordingly, the invention is not to be limited except as by the appended claims.

I claim:

1. An articulated crane comprising:

a base;

a main boom having a lower end and an upper end, and being pivotally secured to said base by said lower end;

a secondary boom pivotally attachable to the upper end of said main boom, and having at least one extensible member; and conversion means, for converting said crane for operation of said extensible member as an extension of said main boom, said conversion means including means for extension of said extensible member from either end of said secondary boom, and means for securing said main and secondary booms in a substantially parallel and folded relationship, with said extensible member forming an extension of said main boom, whereby said crane can be selectively operated as a straight boom crane.

2. An articulated crane comprising:

a base;

a main boom having a lower end and an upper end, and being pivotally secured to said base by said lower end;

a secondary boom having at least one extensible member;

coupling means for pivotal attachment of said secondary boom to said upper end of said main boom, for movement in a substantially vertical plane; and means for securing said secondary boom in a practically parallel relationship with said main boom, with said extensible member extending from a position adjacent to said upper end of said main boom.

3. An articulated crane as defined in claim 2, wherein said extensible member is telescopically mounted within said secondary boom.

4. An articulated crane as defined in claim 2, wherein said coupling means include:

first coupling means pivotally attached to said upper end of said main boom;

second coupling means rigidly attached to said secondary boom at an end remote from said extensible member; and releasable means for connecting said first and second coupling means rigidly together.

5. An articulated crane as defined in claim 4, wherein said first coupling means include a pair of side plates.

6. An articulated crane as defined in claim 5, wherein said second coupling means include attachment plates.

7. An articulated crane as defined in claim 6, wherein said releasable means include pins, and said side plates and said attachment plates have corresponding holes sized to receive said pins.

8. An articulated crane as defined in claim 7, wherein said pins are tapered.

9. An articulated crane as defined in claim 4, wherein said means for securing incudes third coupling means rigidly attached to said secondary boom at the end adjacent to said extensible member, and said releasable means can be employed to couple said first and third coupling means together to provide straight boom operation.

10. An articulated crane as defined in claim 9, wherein said first coupling means includes a pair of side plates.

11. An articulated crane as defined in claim 10 wherein and said third coupling means include attachment plates.

12. An articulated crane as defined in claim 11, wherein said releasable means include pins, and said side plates and said attachment plates have corresponding holes sized to receive said pins.

13. An articulated crane as defined in claim 12, wherein said pins are tapered.

14. An articulated crane as defined in claims 6 or 11, wherein said secondary boom has centering posts that contact and guide said side plates for alignment with said attachment plates.

15. An articulated crane as defined in claim 9, wherein said crane has means to prevent rotation of said secondary boom into said main boom when carrying a load with said extensible member in a position adjacent to said upper end of said main boom.

16. An articulated crane as defined in claim 15, wherein said means to prevent rotation include stop plates.

17. An articulated crane as defined in claim 2, wherein said extensible member is also extensible from the end of said secondary boom adjacent to said upper end of said main boom, and said means for securing includes means for folding said secondary boom under said main boom for straight boom operation.

18. An articulated crane as defined in claim 17, wherein said extensible member has means for selective attachment of a boom tip assembly to both of its ends.

19. An articulated crane comprising:

a base;

a main boom having a lower end and an upper end, and being pivotally secured to said base by said lower end;

a boom tip assembly for carrying a load;

a secondary boom having at least one telescopically extensible member for supporting said boom tip assembly;

main boom coupling means for attachment of said main boom to said secondary boom; and first and second secondary boom coupling means for selected cooperation with said main boom coupling means, said first coupling means pivotally coupling the end of said secondary boom remote from said extensible member to said main boom, for movement in a substantially vertical plane, and said second coupling means coupling the end of said secondary boom from which said extensible member extends adjacent to said upper end of said main boom, for operation of said extensible member as an adjustable extension of the reach of said main boom.

20. An articulated crane as defined in claim 19, wherein said main boom coupling means include a pair of side plates.

21. An articulated crane as defined in claim 19, wherein said first and second secondary boom coupling means include attachment plates.

22. An articulated crane comprising:

a base;

a main boom having a lower end and an upper end, and being pivotally secured to said base by said lower end;

a boom tip assembly for carrying a load;

a secondary boom pivotally coupled at one end to said upper end of said main boom, and having at least one telescopically extensible member selectively extensible from either end of said secondary boom, said extensible member having means for supporting said boom tip assembly at either end of said member; and means for securing said main and secondary booms in a substantially parallel and folded relationship.

* * * * *